US005709632A

United States Patent [19]

Socwell

[11] Patent Number: 5,709,632

[45] Date of Patent: Jan. 20, 1998

[54] CURVED DECK TREADMILL

[75] Inventor: Jeff D. Socwell, Logan, Utah

[73] Assignee: Precor Incorporated, Bothell, Wash.

[21] Appl. No.: 721,724

[22] Filed: Sep. 27, 1996

[51] Int. Cl.[6] ..... A63B 22/02

[52] U.S. Cl. ..... 482/54; 482/51

[58] Field of Search ..... 482/51, 54, 70, 482/71

[56] References Cited

U.S. PATENT DOCUMENTS

| | | | |
|---|---|---|---|
| 1,211,765 | 1/1917 | Schmidt . | |
| 3,554,541 | 1/1971 | Seaman . | |
| 3,642,279 | 2/1972 | Cutter . | |
| 4,389,047 | 6/1983 | Hall . | |
| 4,616,822 | 10/1986 | Trulaske et al. | 482/54 |
| 4,938,473 | 7/1990 | Lee et al. . | |
| 5,100,127 | 3/1992 | Melnick et al. | 482/54 |
| 5,125,361 | 6/1992 | Rowlands . | |
| 5,391,129 | 2/1995 | Zaitsev . | |
| 5,431,612 | 7/1995 | Holden | 482/54 |
| 5,575,740 | 11/1996 | Piaget et al. | 482/51 |

*Primary Examiner*—L. Reichard

*Attorney, Agent, or Firm*—Christensen O'Connor Johnson & Kindness PLLC

[57] ABSTRACT

A curved deck treadmill is disclosed in one presently preferred embodiment of the present invention as comprising a support frame comprising a first side and a second opposing side having a deck supportably disposed therebetween. In preferred design, the deck comprises a first end, a second end, and an intermediate portion disposed between the first and second ends. The intermediate portion of the deck is preferably formed having a substantially arcuate configuration such that a significant portion of the intermediate portion may be operably disposed dimensionally lower in longitudinal relation to the first and second ends of the deck. Further, a roller assembly is provided preferably comprising a first and second roller. The first roller may be rotatably disposed contiguous the first end of the deck between the first side and the second side of the support frame. Correspondingly similar in construction and design, a second roller is preferably disposed contiguous the second end of the deck between the first and second sides of the support frame. In operation, an endless belt may be rotatably mounted in relation to the roller assembly and operatively disposed in relation to the deck, whereby providing a structurally supported arcuate shaped, moveable surface on which a user may exercise.

19 Claims, 5 Drawing Sheets

CURVED DECK TREADMILL

BACKGROUND

1. The Field of the Invention

This invention relates to exercise treadmills and, more particularly, to novel systems and methods for providing a curved deck treadmill.

2. The Background Art

In an effort to generally improve one's health, many people regularly exercise on treadmills by walking, jogging and/or running along a rotating surface. Although exercise treadmills have been found to be useful, the exercise treadmills of the prior art incorporate several inherent disadvantages.

Traditionally, prior art exercise treadmills may be constructed comprising an endless belt rotatably disposed in relation to a plurality of anti-friction rollers which are rigidly secured to a frame. A significant disadvantage of prior art exercise treadmills of this general type may include the uncomfortable vibrating sensation and/or bruising which is commonly realized by a user when attempting to exercise thereon. In addition, if sufficient frictional resistance is not found in relation to the rotation of the free-moving rollers rotatably engaging the belt, a user attempting to exercise on the treadmill may suffer from injuries sustained as a result of an uncontrolled rotation of the anti-friction rollers engaging the belt. In particular, if the rollers supportably disposed in relation to the endless belt are so easily moveable, the user may potentially lose his equilibrium or balance and fall from the exercise treadmill resulting in possible injuries.

In an attempt to reduce the potential dangers associated with falling from prior art exercise treadmills comprising anti-frictional, free-moving rollers, those skilled in the art developed rollers providing frictional resistance in relation to the inherent rotation of the rollers and the belt. Prior art exercise treadmills having frictional resistance in relation to the rollers, however, are typically found to have a difficulty in maintaining a sufficient balance between too much resistance and not enough. If, for example, the rollers are incapable of storing sufficient kinetic energy to overcome the established frictional resistance, after the rollers of the treadmill begin to rotate, the belt supportably disposed in relation to the rollers generally will not have the tendency to continue in a rotational motion. In this regard, exercise treadmills of the prior art should generally balance these competing factors and provide a corresponding frictional resistance that accommodates a smooth, continuous movement of the belt, without encountering a series of stops or starts that may result in simultaneous jerking motions in the movement of the endless belt.

To address the foregoing problems associated with frictional resistant roller assemblies, those skilled in the art developed exercise treadmills having a motor disposed in relation to the rollers to provide a means for regulating a constant rotational speed of the rotating endless belt. As realized, prior art exercise treadmills incorporating a motor for driving the rotational speed of the rollers and belt commonly obviate the requirement to balance the resistance and stored kinetic energy customarily needed in prior art exercise treadmills embodying frictional resistance roller assemblies.

A meaningful disadvantage of prior art motorized exercise treadmills includes the general disposition or placement of the motor in relation to the roller assembly and belt. Accordingly, the motor may be generally disposed either in front of, behind, or at one side of the endless belt. The usual placement or disposition of the motor in relation to prior art exercise treadmills, however, typically minimizes valuable space which could be alternatively allocated to the disposition of other internally working components of the treadmill or for the purpose of increasing the walking surface provided by the dimensional size of the belt.

In accordance with prior art exercise treadmills comprising a flat, horizontal or slightly inclined moveable surface, the endless belt supportably disposed in relation to the rollers will typically absorb the full impact force of the foot of a user repetitively depressed thereagainst. The impact force sustained by the endless belt of prior art exercise treadmills generally produces a breaking effect which causes temporary stalling of the rotational movement of the belt. This undesirable stalling motion of the belt typically alters the continuity of the user's exercise routine and may further institute jerking movements with each step of the user. As the force or pressure associated with the impact of the user's feet on the flat, horizontal surface increases, the more likely prior art exercise treadmills will realize this breaking effect. In this regard, a heavy person running on a horizontal belt supported by rollers engaging a frame will more likely introduce a consistent breaking effect on the rotational movement of the belt, than a lighter person walking on the same treadmill.

Similarly, exercise treadmills of the prior art were developed to provide a springy and resilient walking surface. Prior art exercise treadmills of this type and the flat surface treadmills of the prior art, however, commonly encourage a form of bobbing effect in relation to the up and down motion of the user's body in relation to the moveable surface or belt of the treadmill. This continual bobbing up and down usually makes it nearly impossible for a user to reach and maintain a steady position on the surface of the belt of the treadmill. In addition, because the support structure disposed in relation to the rotating belt is formed to provide a springy and resilient walking surface, a user may feel as if he is wading on the treadmill, rather than walking, jogging or running. Consistent therewith, these types of prior art exercise treadmills are generally unable to satisfactorily simulate natural walking, jogging or running.

Another meaningful disadvantage of exercise treadmills of the prior art is the inherent danger associated with users tending to fall off the back end of the treadmill and become injured. Several attempts have been made to keep a user exercising on prior exercise treadmills from falling off the back end of the endless belt and from the treadmill frame. For example, prior art exercise treadmills were developed by those skilled in the art which include a belt for harnessing the user to the treadmill. Unfortunately, harnessing a user to the treadmill is often found to be as dangerous as falling off the back of the treadmill.

Additionally, exercise treadmills of the prior art may furnish a user with an upright handle to grasp while exercising. While somewhat useful in retaining the user's balance on the rotating endless belt, having to grasp a fixed handle may impede the natural body motion of a user attempting to exercise. Such an encumbrance may be feasible when a user is attempting to walk, but when a user begins to jog or run on prior art exercise treadmills, having to grasp a handle to keep centered on the treadmill may severely interfere with one's natural body motion and further abdicate the inherent physical advantages of the exercise routine.

Another meaningful disadvantage of prior art exercise treadmills is their general inability to reduce the physical impact to the joints and muscles of a user conducting general exercise routines in relation thereto. In this regard, an exercise treadmill which is capable of reducing the physical impact on the knees and back of a user will resolve several barriers left unsolved by known prior art devices, especially in light of providing an operative role in rehabilitative exercises.

Consistent with the foregoing and as illustrated by the number of prior art patents and other disclosures, efforts are continuously being made in an attempt to remedy the above-identified disadvantages. While prior art exercise treadmills may appear generally suitable for their intended purpose, they nevertheless leave much to be desired from the standpoint of effectiveness of operation, safety, reducing the physical impact to the joints and muscles of a user, and simulating the natural body motion of the user exercising thereon. In this regard, the present invention provides for a novel curved deck treadmill which overcomes several deficiencies of exercise treadmills of the prior art and resolves several problems left unsolved by the known prior art.

BRIEF SUMMARY AND OBJECTS OF THE INVENTION

In view of the foregoing, it is a primary object of the present invention to provide a novel curved deck treadmill which provides a structurally supported arcuate shaped, moveable surface on which a user may exercise.

It is also an object of the present invention to provide a curved deck treadmill which comprises a first end and a second end disposed substantially parallel in dimensional relationship and including a deck having an intermediate portion disposed therebetween comprising a substantially arcuate longitudinal configuration which is disposed lower in dimensional relation to the first and second ends.

Further, it is an object of the present invention to provide a curved deck treadmill which maximizes the upper surface area of the belt by effective disposition of a driving means.

It is a still further object of the present invention to provide a curved deck treadmill which substantially prevents a user from falling off the back end of the treadmill and whereby serving to keep the user centered on the upper surface of the treadmill without encumbering the natural body motion of the user exercising thereon.

In addition, it is an object of the present invention to provide a curved deck treadmill which is capable of providing meaningful walking, jogging, or running comfort in relation to the physiology of a user, thereby facilitating an upper surface which supportably provides for a longer stride with more flexibility.

Moreover, it is an object of the present invention to provide a curved deck treadmill which is capable of reducing the physical impact to the joints and muscles (e.g., the knees and back) of a user, thus providing an operative device having rehabilitative functionality.

Similarly, it is an object of the present invention to provide a curved deck treadmill which provides a continuous, smooth exercising motion.

Consistent with the foregoing objects, and in accordance with the invention as embodied and broadly described herein, a curved deck treadmill is disclosed in one embodiment of the present invention as including a support frame comprising a first side and a second opposing side having a deck supportably disposed therebetween. In preferred design, the deck comprises a first end, a second end, and an intermediate portion disposed between the first and second ends. The intermediate portion of the deck is preferably formed having a substantially arcuate configuration such that a significant portion of the intermediate portion may be operably disposed dimensionally lower in longitudinal relation to the first and second ends of the deck. Further, a roller assembly is provided preferably comprising a first and second roller. The first roller may be rotatably disposed contiguous the first end of the deck between the first side and the second side of the support frame. Correspondingly similar in construction and design, a second roller is preferably disposed contiguous the second end of the deck between the first and second sides of the support frame. In operation, an endless belt may be rotatably mounted in relation to the roller assembly and operatively disposed in relation to the deck, whereby providing a structurally supported arcuate shaped, moveable surface on which a user may exercise.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENT@S

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
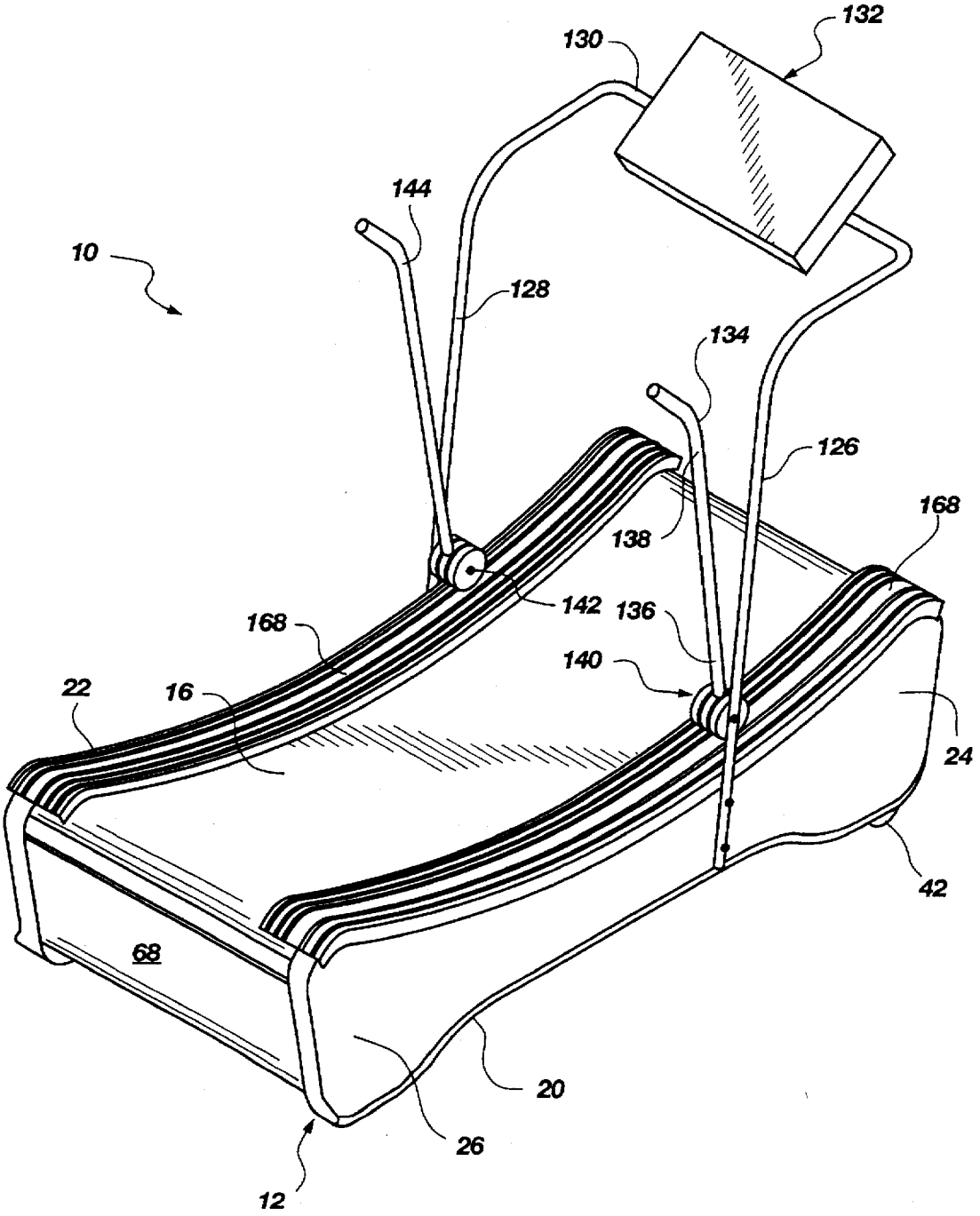
FIG. 1 is a perspective view of one presently preferred embodiment of a curved deck treadmill.
Figure 2:
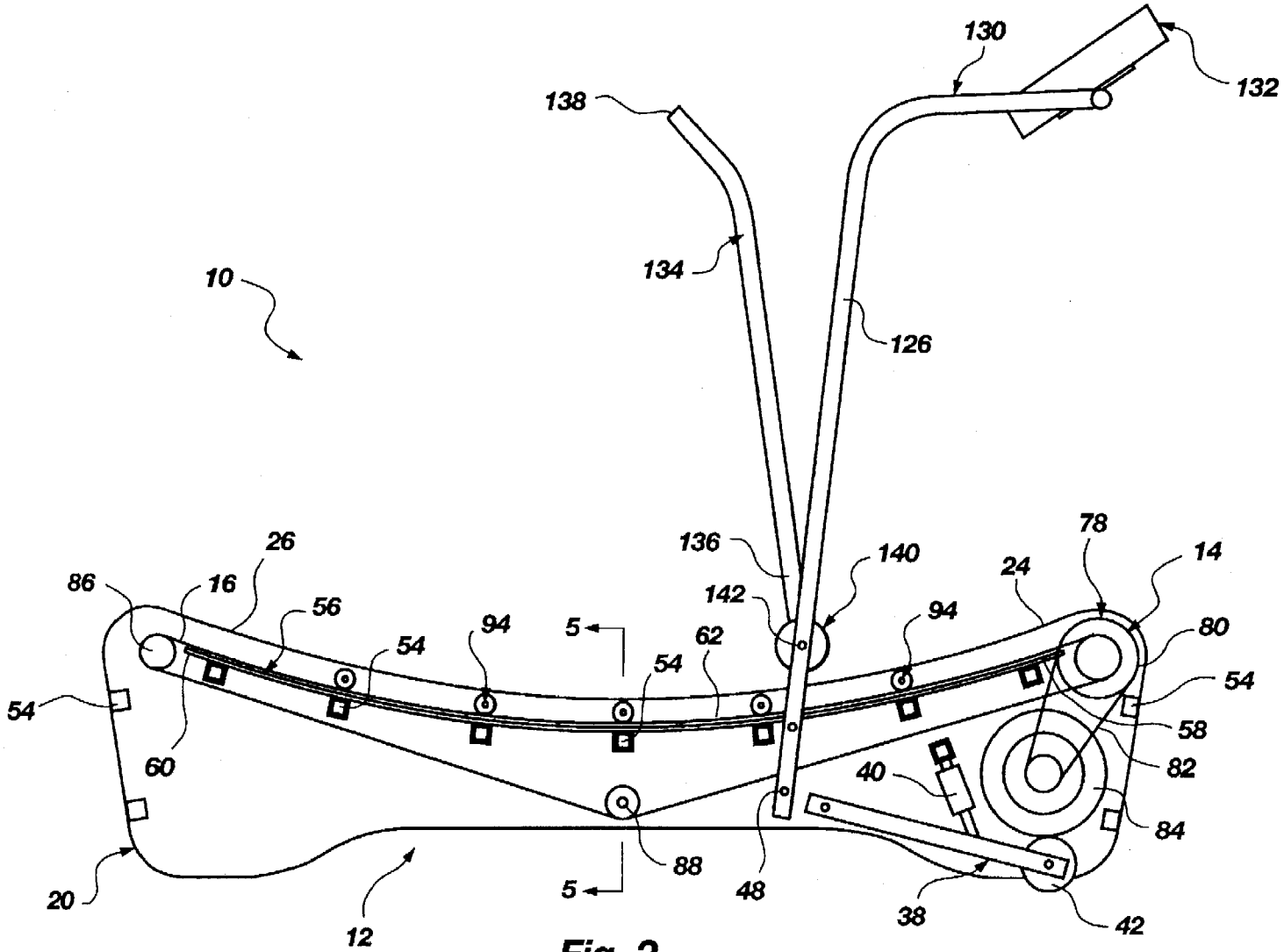
FIG. 2 is a side elevational view of the embodiment of FIG. 1 exposing one presently preferred arrangement of the internal components of the present invention.

One presently preferred embodiment of the present invention, designated generally at 10, is best illustrated in FIGS. 1 and 2. As shown, the curved deck treadmill 10 comprises a support frame 12 having a first side 20 and a second opposing side 22 and having a deck 56 supportably disposed therebetween. In preferred construction, the deck 56 comprises a first end 58, a second end 60, and an intermediate portion 62 disposed therebetween. The intermediate portion 62 of the deck 56 is preferably formed having an arcuate configuration such that a significant portion of the intermediate portion 62 may be operably disposed dimensionally lower in longitudinal relationship to the first and second ends 58, 60 of the deck 56. Further, a roller assembly 14 is provided preferably comprising a first and second roller 78, 86. The first roller 78 may be rotatably disposed contiguous the first end 58 of the deck 56 between the first side 20 and the second opposing side 22 of the support frame 12. Correspondingly similar in construction and design, a second roller 86 is preferably disposed contiguous the second end 60 of the deck 56 between the first and second sides 20, 22 of the support frame 12. In preferred operation, a belt 16 is rotatably mounted in relation to the roller assembly 14 and operatively disposed in relation to the deck 56, thereby providing a structurally supported arcuate shaped, moveable surface on which a user may exercise.

As further illustrated in FIGS. 1 and 2, at least one crossbar 130 may be structurally supported in relation to the support frame 12. Preferably, the crossbar 130 functionally supports a console 132 substantially above the upper surface area of the support frame 12, deck 56, and belt 16. Disposed in relation to the support frame 12, the crossbar 130 may be formed having a generally U-shaped configuration. Further, the crossbar 130 may comprise a pivotal engagement 140 which provides a means for pivotally engaging one or more handles 134, 144 in relation to the crossbar 130 at the opposing sides thereof 126, 128.

Structurally, the support frame 12 preferably comprises a first side 20 and a second opposing side 22 which, in combination, provide a means for structurally supporting the curved deck treadmill 10 and the various components thereof. In one preferred embodiment of the present invention, the support frame 12 is preferably formed of a substantially sturdy, rigid material which provides sufficient structural integrity to support the curved deck treadmill 10 and a user exercising thereon. For example, the support frame 12 may be formed of any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. It will be readily appreciated by those skilled in the art, however, that a wide variety of other suitable materials such as, metal or metal alloys, fiberglass, wood, ceramic, graphite and/or other composite or polymeric materials are possible which are consistent with the spirit and scope of the present invention.

Preferably, the support frame 12 may be formed having a first side 20 being disposed substantially parallel a second opposing side 22, thereby providing a generally longitudinal alignment therebetween. In one presently preferred embodiment of the present invention, because the first side 20 and the second side 22 of the support frame 12 are relatively constructed having a substantially comparable structure and configuration, only the first side 20 will be operatively disclosed in detail herein. Any structural variations which exist between the first side 20 and the second opposing side 22 will be further disclosed herein, thus noting such variations which exist between the first side 20 and the second opposing side 22 will be further disclosed, whereby noting such variation(s).

Figure 3:
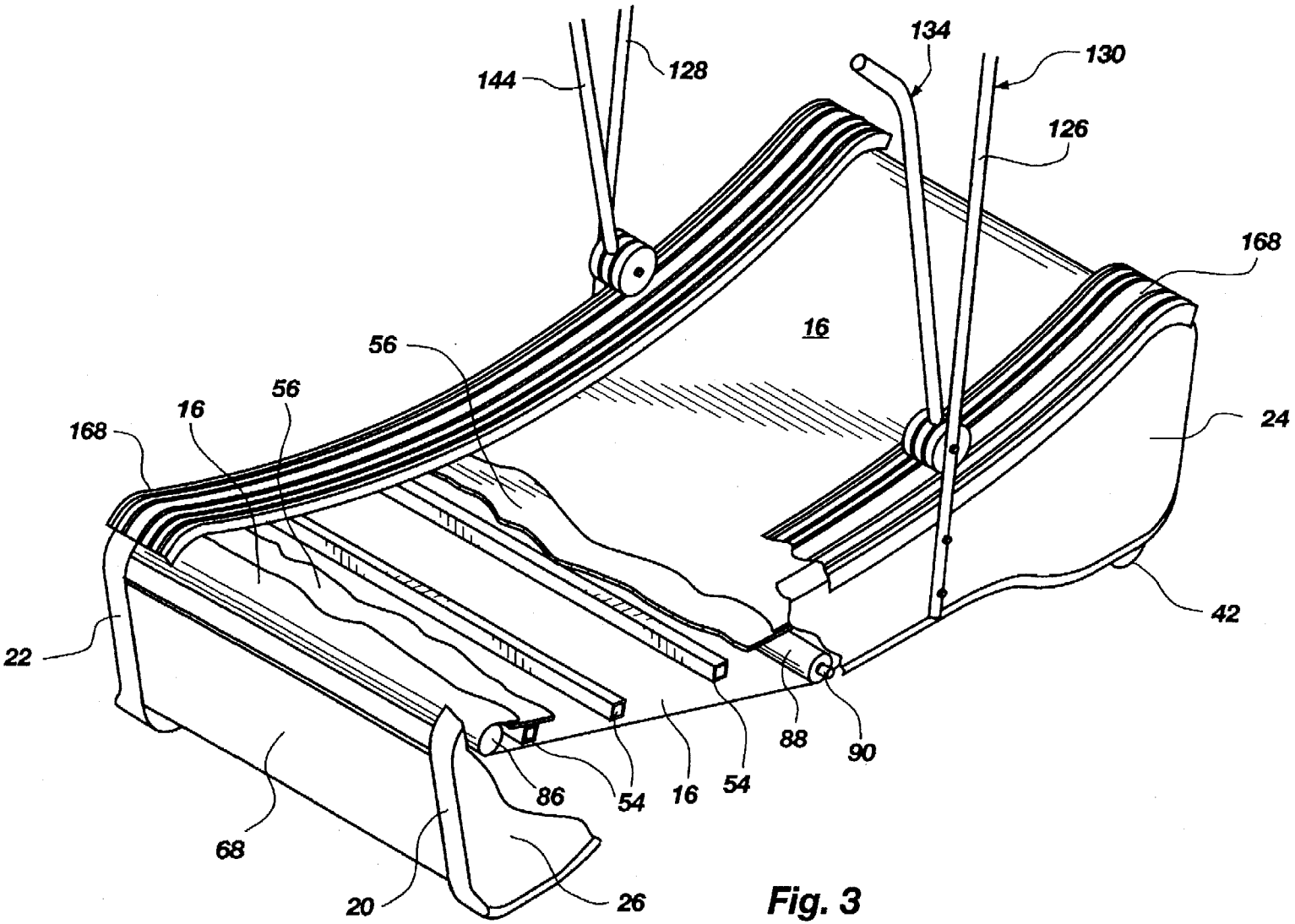
FIG. 3 is a cut-away view of the embodiment of FIG. 1.
Figure 4:
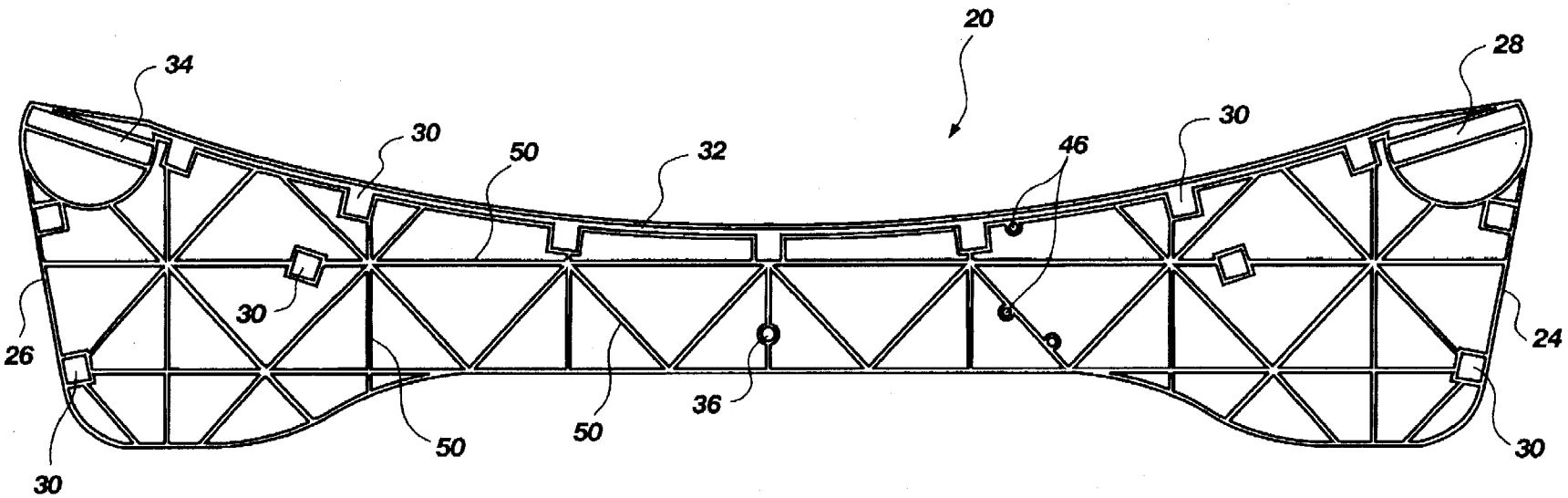
FIG. 4 is a side elevational view of one presently preferred embodiment of one side of a support frame of one presently preferred embodiment of the present invention.

As shown in FIGS. 1 and 3, the first side 20 of the support frame 12 includes a first end 24 and a second opposing end 26. The first and second ends 24, 26 of the first side 20 are preferably disposed in corresponding relation to the first and second ends 58, 60 of the deck 56. As best illustrated in FIGS. 2 and 4, a first journal housing 28 may be formed substantially adjacent the first end 24 of the first side 20 of the support frame 12. Preferably, the first journal housing 28 is formed having an opening readily adapted to receive at least one journaling end (not shown) of the first roller 78. Similarly, a second journal housing 34 may be formed substantially adjacent the second end 26 of the first side 20 of the support frame 12 and include an opening readily adapted to receive at least one journaling end (not shown) of the second roller 86.

In preferred design, the journal housings 28, 34 formed at the first and second ends 24, 26 of the first side 20 of the support frame 12, respectively, may be formed having an opening which provides a means for facilitating the introduction of the journaling ends of the respective first and second rollers 78, 86. Preferably, the opening comprises an elongated slot wherein the journaling ends of the first and second rollers 78, 86 may be slideably adjusted. By introducing the journaling ends of the first and second rollers 78, 86 in the respective elongated slots formed in the journal housings 28, 34 of the support frame 12, the horizontal displacement of the belt 16 may, accordingly, be adjusted in relation to the disposition of the first and second rollers 78, 86.

Figure 5:
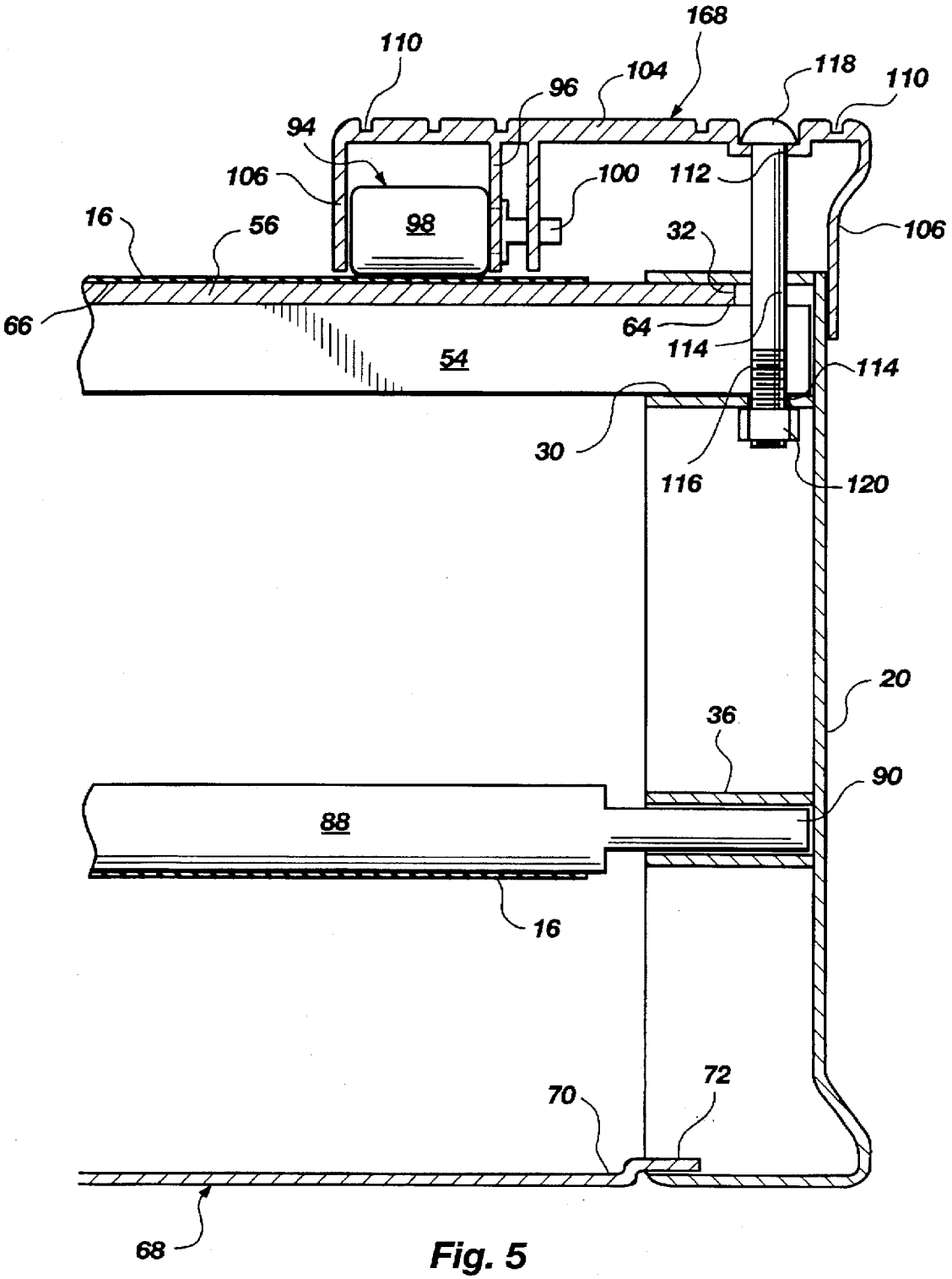
FIG. 5 is a exploded, fragmentary cross-sectional view of the embodiment of FIG. 2 taken along lines 5—5 of FIG. 2.

In one presently preferred embodiment of the present invention, a third journal housing 36 may be formed in the first side 20 of the support frame 12, as best illustrated in FIGS. 2, 4 and 5. Preferably formed between the first journal housing 28 and the second journal housing 34 of the first side 20 of the support frame 12, the third journal housing 36 may be disposed dimensionally lower than the substantially horizontal displacement of the first and second journal housings 28, 34. Consistent with the first and second journal housings 28, 34, the third journal housing 36 is preferably formed including an opening having an internal periphery sufficient for introducing at least one journaling end 90 of the third roller 88 therein, as shown in FIG. 5. Preferably, the journaling end 90 of the third roller 88 is formed having a substantially cylindrical configuration comprising an outer diameter which is less than the internal diameter of the opening formed in the third journal housing 36. It will be readily appreciated by those skilled in the art, however, that other shapes, sizes and/or configurations of the journal housings 28, 34, 36 and/or the internal openings formed therein are possible as such to provide a means for introducing at least one journaling end of the first, second and third rollers 78, 86, 88, respectively, therein.

In accordance with one presently preferred embodiment of the present invention, the journal housings 28, 34, 36 formed in the first side 20 of the support frame 12 may be disposed in operative alignment with the journal housings formed in the second side 22 of the support frame 12. This arrangement of the journal housings 28, 34, 36 in both the first and second sides 20, 22 of the support frame 12 preferably provides for the introduction and retention of the journaling ends of the corresponding rollers 78, 86, 88, thereby facilitating a means for rotating the rollers on a substantially fixed axis.

Although the journal housings 28, 34, 36 of the first and second sides 20, 22 of the support frame 12 preferably receive the journaling ends of the respective rollers 78, 86, 88, it will be apparent to those skilled in the art that other mechanisms may be constructed and/or numerous other relative dispositions of the respective rollers may be anticipated in accordance with the inventive principles disclosed herein in order to achieve the desired results of the present invention. It is intended, therefore, that the examples provided herein be viewed as exemplary of the principles of the present invention, and not as restrictive to a particular structure or structures for implementing those principles.

Referring back to FIGS. 1 and 2, the belt 16 operably disposed in relation to the rollers 78, 86, 88 may be formed comprising an endless construction which preferably consists of a sufficiently sturdy material. For example, the belt 16 may be formed of an endless sheet of a flexible canvas or a rubber-impregnated material. The belt 16 may alternatively be formed of a thin, flat band of steel or a sufficiently tenacious polymeric or composite material. As will be readily appreciated by those skilled in the art, the belt 16 can, of course, be formed of a wide variety of suitable materials which are consistent with the spirit and scope of the present invention.

In accordance with one preferred arrangement, the belt 16 is rotatably disposed in relation to the first roller 78, the second roller 86, and the third roller 88, whereby each roller 78, 86, 88 is preferably disposed in structural relation to the support frame 12 at their respectively preferred positions, as disclosed above. The tension of the belt 16 may be readily tightened or loosened in relation to the disposition of the first and second rollers 78, 86 engageably disposed in the respective elongated slot of the journal housings 28, 34. Moreover, a conventional fixation member (not shown) may be utilized to provide a means for disposing the journaling ends of the rollers 78, 86, 88 in a fixed and/or adjustable relationship to the respective opening or elongated slot formed in the journal housings 28, 34, 36 of the support frame 12.

Referring back to the features of the support frame 12, a deck slot 32 may be formed which extends substantially the longitudinal length of the first side 20, as shown in FIG. 4. Preferably, the deck slot 32 is disposed such that the deck 56 may be insertably disposed therein. In one presently preferred embodiment of the present invention, the deck slot 32 comprises a substantially curvilinear configuration which substantially corresponds in dimensional shape to the arcuate configuration of the intermediate portion 62 of the deck 56. Similarly, the deck slot 32 is preferably formed having a sufficient size and depth sufficient to retain at least one longitudinal side of the deck 56 engageably inserted therein, such that any possible flexing of the deck 56 from the weight of a user will not generally unseat the deck 56 from the deck slot 32. Whereas, the opposing longitudinal side of the deck 56 is preferably disposed within the deck slot 32 formed in the second side 22 of the support frame 12.

In preferred construction, the deck 56 is formed of a substantially sturdy, rigid material to provide sufficient structural integrity to adequately support the weight of a user exercising on the curved deck treadmill 10. In one presently preferred embodiment of the present invention, the deck 56 is preferably formed consisting of a wood laminate having an upper surface 66 that may be impregnated with a wax material to provide a means for reducing the coefficient of friction acting thereon. In an alternate embodiment, the deck 56 may be formed of any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. It will be readily appreciated by those skilled in the art, however, that a wide variety of other suitable materials such as, metal or metal alloys, fiberglass, ceramic, graphite and/or other composite or polymeric materials are possible which are consistent with the spirit and scope of the present invention.

As shown in FIG. 4, the first side 20 of the support frame 12 may comprise one or more rib seats 30 disposed adjacent the deck slot 32. The rib seats 30 are preferably formed having an internal surface area sufficient for seating at least one end of a support rib 54 disposed therein. As best illustrated in FIG. 3, one or more support ribs 54 extend substantially transverse dimensionally between the first and second sides 20, 22 of the support frame 12. In preferred construction, the support ribs 54 provide a means for structurally supporting the deck 56. Similarly, the rib seats 30 are preferably formed such that when the support ribs 54 are introduced therein, the deck 56 may be readily disposed within the respective deck slots 32 formed in the first and second sides 20, 22 of the support frame 12 and structurally supported by the support ribs 54 disposed in relation thereto.

In one presently preferred embodiment of the present invention, the support ribs 54 are formed of a sufficiently sturdy, rigid material sufficient to provide adequate structural support to the deck 56. For example, the support ribs 54 may be formed of a rigid metal or metal alloy. It will be readily appreciated by those skilled in the art, however, that a wide variety of other suitable materials such as, fiberglass, ceramic, graphite, any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated, and/or other composite materials are possible that are consistent with the spirit and scope of the present invention.

In current design, the support ribs 54 are formed having a generally elongated configuration which is capable of being seated in a corresponding rib seat 30 disposed in a spaced-apart relation in the first side 20 and the second opposing side 22 of the support frame 12. Accordingly, the rib seats 30 have a corresponding dimensional shape which provides a means for introducing and retaining the ends of the support ribs 54 therein.

As will be readily appreciated, the quantity and disposition of rib seats 30 and engaging support ribs 54 supportably disposed in relation to the support frame 12 may vary according to the structural integrity generally required to support the deck 56 and the weight of a user. For example, the addition of rib seats 30 and support ribs 54 near the first and second ends 24, 26 of the support frame 12 may increase the overall structural integrity of the deck 56 in relation to the support frame 12. Accordingly, those skilled in the art will readily recognize other possible modifications and adaptations which are consistent with the spirit and scope of the present invention.

In addition to the support ribs 54 which provide a means for engageably supporting the first and second sides 20, 22 of the support frame 12, the support frame 12 may include a plurality of structural reinforcement members 50 disposed in relation to the first and second sides 20, 22, as best shown in FIG. 4. As illustrated, the plurality of reinforcement members 50 may be disposed horizontally, vertically, and/or diagonally throughout the sides 20, 22 to provide a means for increasing the ability of the first and second sides 20, 22 to resist buckling or a loss of structural integrity. In one presently preferred embodiment of the present invention, the structural members 50 are preferably formed along the interior surface of the first side 20 of the support frame 12. It will be readily appreciated by those skilled in the art, however, that other structural reinforcing components may be added to further enhance the supportable nature of the support frame 12 or for enhancing the inherent aesthetics of the device.

In one presently preferred embodiment of the present invention, the first side 20 of the support frame 12 may comprise at least one conventional foot roller assembly 38 mountably disposed in relation thereto, as best shown in FIG. 2. The foot roller assembly 38 preferably includes one or more wheels 42 rotatably connected thereto in such a manner so as to provide a means for readily moving the curved deck treadmill 10. The foot roller assembly 38 may further comprise a force absorbing member 40 disposed in relation thereto which provides a means for absorbing any forces or shocks sustained while moving the present invention from one location to another. Correspondingly, the force absorbing member 40 may consist of a conventional shock absorber which is useful over rough surfaces in absorbing sudden movement, bounces, etc.

The force absorbing member 40 may also include a means for stabilizing the curved deck treadmill 10 at an elevated position so as to provide a means for inclining the front end 24 of the support frame 12 for increasing user workout. In this regard, the force absorbing member 40 may comprise a gas or oil filled shock or, in the alternative, an electric gear motor having a locking shaft which elevates the front end 24 of the support frame 12. It will be apparent that other mechanisms may be constructed in accordance with the inventive principles set forth herein. It is intended, therefore, that the example provided herein be viewed as exemplary of the principles of the present invention, and not as restrictive to a particular structure for implementing those principles.

As mentioned above, the second opposing side 22 of the support frame 12 is correspondingly similar in dimensional structure and configuration to that of the first side 20. Accordingly, the components disposed on or in relation to the first side 20 of the support frame 12 are preferably disposed on or in relation to the second side 22. The incorporation of substantially comparable sides 20, 22 of the support frame 12 comprises one presently preferred embodiment. It is intended, therefore, that the example provided herein be viewed as exemplary of the principles of the present invention, and not as restrictive to a particular structure for implementing those principles. Accordingly, the utilization of a support frame having correspondingly similar sides is thus by way of illustration only and not by way of limitation.

Referring now to FIG. 5, the curved deck treadmill 10 may include one or more belt securing assemblies 94 which provide a means for retaining the endless belt 16 in a curvilinear configuration being substantially flush with the upper surface 66 of the deck 56. Preferably, the belt securing assemblies 94 provide a means for substantially conforming the inherent flexible nature of the belt 16 to the arcuate configuration of the intermediate portion 62 of the deck 56. In design, one or more belt securing assemblies 94 may be disposed in spaced-apart relation along the upper surface 66 of the intermediate portion 62 of the deck 56, as shown in FIG. 2, to sufficiently retain the belt 16 in operable disposition to the deck 56.

In one presently preferred embodiment of the present invention, the belt securing assembly 94 comprises a roller 98 having an axle 100 which rotatably engages a mounting bracket 96. The mounting bracket 96 is preferably disposed in relation to the roller 98 such that the roller 98 may engage the belt 16, thereby substantially retaining a side portion of the belt 16 substantially flush with the deck 56. In preferred operation, as the belt 16 rotates in relation to the roller assembly 14, the rollers 98 of the belt securing assembly 94 preferably rotate in relation thereto. It will be apparent that other belt securing mechanisms may be constructed in accordance with the inventive principles set forth herein. Correspondingly, those skilled in the art may recognize other possible modifications and/or adaptations which are consistent with the spirit and scope of the present invention.

Referring back to FIGS. 1 and 3, a cover member 68 may be disposed in connection between the first and second sides 20, 22 of the support frame 12. The cover member 68 is preferably formed providing a means for covering the internal components of the curved deck treadmill 10. In current design, the cover member 68 may be removably disposed in connection to the first and second sides 20, 22 of the support frame 12 whereby allowing for easy access to the internal working components of the present invention. For example, the cover member 68 may be attached to the support frame 12 by a series of tabs 72 disposed along the outer edge 70 of the cover member 68 and arranged in such a manner so as to removably engage the first and second sides 20, 22, as illustrated depicted in FIG. 5. Additionally, a cover member 168 may provide a means for covering the belt securing assemblies 94 disposed in relation to the first and second sides 20, 22 of the support frame 12.

In preferred structure, the cover member 168 which is disposed in relation to covering the belt securing assembly 94 may comprise a horizontal portion 104 disposed in relation to one or more vertical sides 106. As discussed above, the mounting bracket 96 may be fixed to the cover member 168 such that it provides a means for assisting in the rotational alignment of the roller 98 of the belt securing assembly 94. Preferably, at least one vertical side 106 is disposed adjacent the roller 98 of the belt securing assembly 94 such that the vertical side 106 and the horizontal portion 104 of the cover member 168 substantially cover the belt securing assembly 94. Further, one or more longitudinal grooves 110 may be formed in the exterior surface of the horizontal portion 104 of the cover member 168, as best shown in FIGS. 1, 3 and 5. As will be readily appreciated, the cover member 168 may include other structural components for either functional or aesthetic reasons.

In one presently preferred embodiment of the present invention, the cover members 68, 168 are preferably formed of a substantially sturdy, semi-flexible material. For example, the cover members 68, 168 may be formed of any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. It will be readily appreciated by those skilled in the art, however, that a wide variety of other suitable materials such as, metal or metal alloys, fiberglass, wood, ceramic, graphite and/or other composite or polymeric materials are possible which are consistent with the spirit and scope of the present invention.

Referring now to FIG. 5, the belt securing assembly 94 and the corresponding cover member 68 may be attached to the support frame 12 by a conventional fastening means. For example, in one presently preferred embodiment of the present invention, a bolt 118 may be disposed through an aperture 112 formed in the cover member 168 and at least one aperture 114 formed in a respective side 20, 22 of the support frame 12. Alternatively, the bolt 118 may be disposed through an aperture 116 formed in a support rib 54 which may further serve to secure the support rib 54 to the support frame 12. Moreover, if a longitudinal side 64 of the deck 56 were to extend past the apertures formed in the cover member 168 and the support frame 12, a corresponding through-bore (not shown) may be formed in the deck 56 and disposed in alignment with the other apertures. If desired, a locking nut 120 may be disposed in relation to a first end of the bolt 118 to secure the preferred engagement outlined above between the various components of the curved deck treadmill 10.

In one presently preferred embodiment of the present invention, a driving means 84 is operably connected to at least one roller to enable the rotation of the belt 16. The driving means 84 preferably comprises a conventional electric motor for rotating the belt 16. In preferred arrangement, a pulley 80 is disposably mounted to the first roller 78 at the first end 24 of the support frame 12. In operation, a pulley belt 82 may be engageably disposed between the pulley 80 and the motor 84 to provide a means for correspondingly rotating the first roller 78 upon the forced rotation of the pulley belt 82 by the motor 84.

As best illustrated in FIG. 2, the motor 84 may be mounted to the support frame 12 substantially adjacent the first end 58 and beneath the deck 56 by means of a fixation bracket (not shown). Alternatively, it will be readily appreciated by those skilled in the art, however, that the motor 84 may be engageably disposed in relation to the second or third rollers 86, 88 to enable the rotation of the belt 16.

In an alternate embodiment, the curved deck treadmill 10 or the present invention may be implemented without a driving means engageably disposed to a roller in order to facilitate the forced rotation of the belt 16. If so implemented, the rollers 78, 86 and 88 and the deck 56 should be generally calibrated in relation to the belt 16 to provide an optimal frictional resistance to enable a user to safely walk, jog, and/or run thereon, while still providing sufficient resistance to enable a user to exercise.

Referring now to FIGS. 1, 2 and 3, a crossbar 130 may be preferably formed having a generally U-shaped configuration and may be disposed in fixed relation to the first and second sides 20, 22 of the support frame 12 by means of conventional fasteners. The fasteners may comprise one or more internally threaded seats 46 (as best shown in FIG. 4) wherein an appropriately sized fastener 48 may be introduced to provide a threaded or force-fit engagement therebetween for securing the first side 126 of the cross-bar 130 to the first side 20 of the support frame 12. A second end 128 of the crossbar 130 may be similarly mounted in a preferably fixed engagement to the second side 22 of the support frame 12. Although the crossbar 130 of the present invention is illustrated and described in connection with a generally U-shaped configuration, those skilled in the art will recognize that various other geometrical configurations are likewise suitable. The use of a generally U-shaped configuration is thus by way of illustration only and not by way of limitation.

In one presently preferred embodiment of the present invention, a console 132 is preferably mounted in relation to the cross-bar 130. Supportably disposed by the cross-bar 130, the console 132 may be mounted substantially above the support frame 12, the deck 56, and the belt 16 such that a user may view the information displayed on the console 132. The console 132 preferably comprises a processor, a display, and may include input keys for entering user programmable options. Similarly, the console 132 may provide a variety of feedback data, such as elapsed time, speed, distance, pulse rate, and/or other functions and features, as desired.

It will be appreciated by those skilled in the art that the console 132 may incorporate additional external components and/or devices in carrying out its function. For example, the console 132 may include one or more sensors for ascertaining the rotational speed of the belt 16, a sensor for determining the pulse or heart rate of a user, a device for controlling the speed of the motor, etc. Although such external components and/or devices are not specifically shown in the Figures, it is clearly contemplated by the present invention that such electronic and/or mechanical equipment are readily anticipated herein for utilization with the present invention.

In preferred structure, the crossbar 130 may comprise a pivotal engagement 140 which provides a means for pivotally engaging one or more handles 134, 144 in relation to the opposing sides 126, 128 of the crossbar 130, as illustrated in FIGS. 1, 2 and 3. The handles 134, 144 may be constructed of any suitable rigid material. For example, the handles 134, 144 may be formed of a metal or metal alloy, wood, fiberglass, graphite, ceramic, plastic or any other suitable composite material. Additionally, the handles 134, 144 may include a gripping member (not shown) preferably disposed substantially adjacent the distal ends of the handles 134, 144 to enable a user to more easily grip the handle. In particular, a rubber grip may be disposed in relation to the distal end 138 of the handle 134, 144 and positioned so that a user may grasp the gripping member of the handle 134, 144 when exercising.

Preferably, a first handle 134 includes a pivot end 136, a distal end 138 and an intermediate portion disposed therebetween. As best shown in FIG. 1, the pivot end 136 of the first handle 134 may be pivotally connected to the first side 126 of the crossbar 130 by means of a pivotal connection 140. In current design, the pivotal connection 140 comprises a conventional through-bore and a pivot pin 142 operably disposed therein, whereby providing a pivoting means for the handle 134 to pivot in relation thereto. Similarly, a second handle 144 may be pivotally connected to the second side 128 of the crossbar 130.

In functional operation, the handles 134 and 144 are preferably positioned such that a user may grasp approximate the distal end 138 of the handles 134, 144 while exercising and, accordingly, pivot the handles back and forth in correspondence to the user's stride, whereby potentially invoking an aerobic workout. In an alternative embodiment, the handles 134, 144 may be provided with some conventional form of resistance to further facilitate the exercising of the upper body of a user.

Although the first 134 and second handles 144 are described herein as being connected to the opposing sides 126, 128 of the crossbar 130 by a pivotal connection 140, it will be readily appreciated by those skilled in the art that other points of connection are possible. For example, the first and second handles 134, 144 may be pivotally connected to the first and second sides 20, 22, respectively, of the support frame 12. Alternatively, the handles 134, 144 may be operably connected to the motor 84 to provide a means for encouraging a user to maintain a predetermined, constant stride on the rotating belt 16, while maintaining a constant back-and-forth arm movement.

From the above discussion, it will be appreciated that the present invention provides a novel curved deck treadmill which provides a structurally supported arcuate shaped moveable surface on which a user may exercise. The present invention further provides a curved deck treadmill which maximizes the upper surface area of the belt by effective disposition of the driving means. In addition, the present invention substantially prevents a user from falling off the back of the treadmill and whereby serves to keep the user centered on the upper surface of the rotating belt without encumbering the natural body motion of the user exercising thereon.

Unlike the prior art, the curved deck treadmill of the present invention comprises a first end and a second end disposed substantially parallel in dimensional relationship and including a deck having an intermediate portion disposed therebetween comprising a substantially arcuate longitudinal configuration which is disposed lower in dimensional relation to the first and second ends. Similarly, the novel configuration of the present invention is capable of reducing the physical impact to the joints and muscles (e.g., the knees and back) of a user, thus providing an operative device having rehabilitative functionality. Moreover, the present invention provides a continuous, smooth exercising motion capable of providing meaningful exercise comfort, thereby facilitating an upper surface which supportably provides for a longer stride with more flexibility.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An exercise treadmill, comprising:

a support frame having a first end and a second opposing end, wherein said first end being disposed substantially parallel in dimensional relation to said second end;

a deck having an intermediate portion comprising a substantially arcuate longitudinal configuration, said intermediate portion engageably disposed between said first and second ends of said support frame at a position substantially lower in dimensional relation to said first and second ends;

a roller assembly rotatably disposed in operable relation to said support frame;

a belt rotatably engaging said roller assembly and further disposed in structural relation to said deck, whereby said belt provides a substantially arcuate, selectively moveable surface; and at least one belt securing assembly providing means for retaining said belt substantially flush with said deck.

2. A curved deck treadmill as defined in claim 1 further comprising a driving means operably connected to said roller assembly.

3. Art exercise treadmill as defined in claim 2 wherein said driving means comprises a motor.

4. An exercise treadmill as defined in claim 2 wherein said driving means is mountably disposed in relation to said support member and beneath said deck.

5. An exercise treadmill as defined in claim 1 wherein said support frame comprises a first side and a second opposing side.

6. An exercise treadmill as defined in claim 1 wherein said roller assembly comprises a first roller disposed at said first end of said support frame.

7. An exercise treadmill as defined in claim 6 wherein said roller assembly further comprises a second roller disposed at said second end of said support frame.

8. An exercise treadmill as defined in claim 6 wherein said roller assembly further comprises a third roller disposed between said first end and said second end of said support frame.

9. An exercise treadmill as defined in claim 1 wherein said belt is formed of a flexible material and having an endless configuration.

10. An exercise treadmill as defined in claim 1 further comprising a crossbar supportably disposed in relation to said support frame.

11. An exercise treadmill as defined in claim 10 wherein said crossbar comprises a console mountably disposed in relation thereto.

12. An exercise treadmill as defined in claim 11 wherein said console is programmable.

13. An exercise treadmill as defined in claim 10 wherein said crossbar comprises at least one handle pivotally disposed in relation thereto.

14. An exercise treadmill, comprising:

a support frame having a first end and a second opposing end, said support frame further comprising a first side and a second opposing side;

a deck comprising a first end, a second end, and an intermediate portion, said first end of said deck being disposed substantially parallel in dimensional relation to said second end of the deck, said intermediate portion having a substantially arcuate longitudinal configuration, wherein the intermediate portion is engageably disposed between the first and second ends of the deck at a position substantially lower in dimensional relation thereto;

a first roller rotatably disposed in relation to said first side and said second side of said support frame, said first roller disposed contiguous said first end of said support frame;

a second roller rotatably disposed in relation to said first side and said second side, said second roller disposed contiguous said second end of said support frame;

a flexible, endless belt rotatably engaging said first and second rollers and being further disposed in structural relation to said deck, whereby said belt in cooperation with the first and second rollers and the deck provides a substantially arcuate, selectively moveable surface; and at least one belt securing assembly providing means for rotatably retaining said endless belt substantially flush with said deck.

15. An exercise treadmill as defined in claim 14 further comprising a third roller rotatably disposed in relation to said first and second sides of said support frame and substantially between said first and second ends of the support frame.

16. An exercise treadmill as defined in claim 15 wherein said third roller being operatively disposed beneath said intermediate portion of said deck and rotatably engaging said belt.

17. An exercise treadmill as defined in claim 14 further comprising a driving means mountably disposed in relation to said support frame and beneath said deck.

18. An exercise treadmill as defined in claim 17 wherein said driving means is operably connected to said first roller.

19. An exercise treadmill as defined in claim 14 further comprising at least one support rib extending substantially transverse dimensionally between said first and second sides of said support frame to provide means for structurally supporting the deck.

* * * * *

UNITED STATES PATENT AND TRADEMARK OFFICE

CERTIFICATE OF CORRECTION

PATENT NO. : 5,709,632

DATED : January 20, 1998

INVENTOR(S) : J.D. Socwell

It is certified that error appears in the above-identified patent and that said Letters Patent is hereby corrected as shown below:

| COLUMN | LINE | |
|---|---|---|
| 5 | 60-62 | delete "which exist between the first side 20 and the second opposing side 22 will be further disclosed, whereby noting such variation(s)." and insert therefor --.-- |
| 13 (Claim 3, line 1) | 50 | "Art" should read --An-- |

Signed and Sealed this

Twenty-second Day of December, 1998

Bruce Lehman

*Attest:*

BRUCE LEHMAN

*Attesting Officer*

*Commissioner of Patents and Trademarks*